US008366153B2

(12) United States Patent
Martineck, Sr.

(10) Patent No.: US 8,366,153 B2
(45) Date of Patent: Feb. 5, 2013

(54) SYSTEM AND METHOD FOR DETECTING COMPROMISED INSTANT LOTTERY TICKETS

(75) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 604 days.

(21) Appl. No.: 12/336,580

(22) Filed: Dec. 17, 2008

(65) Prior Publication Data

US 2009/0167012 A1 Jul. 2, 2009

Related U.S. Application Data

(60) Provisional application No. 61/017,188, filed on Dec. 28, 2007.

(51) Int. Cl.
*B42D 15/00* (2006.01)

(52) U.S. Cl. ..... 283/92; 283/100

(58) Field of Classification Search ..... 283/67, 283/95, 100

See application file for complete search history.

(56) References Cited

U.S. PATENT DOCUMENTS 4,726,608 A * 2/1988 Walton ..... 283/96
5,286,061 A 2/1994 Behm
5,599,046 A 2/1997 Behm et al.
6,053,405 A * 4/2000 Irwin et al. ..... 235/375
6,379,742 B1 4/2002 Behm et al.
6,869,015 B2 * 3/2005 Cummings et al. ..... 235/462.25
7,125,017 B2 10/2006 LaPorte et al.
7,550,745 B2 * 6/2009 Brown ..... 250/461.1
2002/0047259 A1 4/2002 Lambert et al.
2008/0090942 A1 * 4/2008 Hovorka ..... 523/200
2008/0122220 A1 5/2008 Brickwood et al.

FOREIGN PATENT DOCUMENTS

WO WO 02/18152 A1 3/2002

OTHER PUBLICATIONS

PCT Search Report, Apr. 27, 2009.

* cited by examiner

*Primary Examiner* — Tashiana Adams
*Assistant Examiner* — Christopher e Veraa
(74) *Attorney, Agent, or Firm* — Dority & Manning, P.A.

(57) ABSTRACT

A scratch-off lottery ticket includes a substrate having at least one play area with play indicia provided thereon. A scratch-off layer is disposed over the play indicia. A luminescent material is disposed relative to the scratch-off layer and the play indicia such that unauthorized removal of the scratch-off layer in an attempt to reveal the underlying play indicia is rendered optically apparent upon subsequent excitation of the play area with an excitation source that excites the luminescent material.

9 Claims, 3 Drawing Sheets

SYSTEM AND METHOD FOR DETECTING COMPROMISED INSTANT LOTTERY TICKETS

PRIORITY CLAIM

The present application claims priority to U.S. Provisional Application Ser. No. 61/017,188, filed Dec. 28, 2007.

FIELD OF THE INVENTION

The present invention relates to instant lottery tickets having a removable scratch-off layer, and more particularly to a system and method for detecting whether such tickets have been compromised prior to sale.

BACKGROUND OF THE INVENTION

"Instant play" lottery tickets are well known in the art. These tickets typically relate to a game theme and include a scratch-off layer or coating (e.g., a removable latex coating) that covers the play indicia printed on the ticket. After purchasing a ticket, a player scratches off the coating and is instantly presented with an indication as to whether the ticket is a winning ticket.

Unfortunately, the scratch-off lottery games tempt certain unscrupulous individuals to "prescreen" tickets to determine which tickets are winners. For example, such individuals look for ways to covertly determine the play indicia under the scratch-off layer without leaving an indication that the ticket has been tampered with. If a store clerk or other individual can determine a winning ticket in this manner, he can easily remove the ticket from sale to the general public for later "purchase" by an accomplice. Such events seriously degrade the integrity and public perception of the lottery game as a fair game of chance.

One approach to overcoming the problem of prescreening of unsold tickets is described in U.S. Pat. No. 6,053,405. This patent describes a system and method for electronic verification of tickets. Electronic circuits are printed on the tickets, for example as a component of the scratch-off coating, and any attempt to alter the coating in order to determine the underlying play indicia results in a change in the electronic signature of the ticket. A verification machine is used to apply an excitation signal to the ticket, and a validation circuit is used to determine if the returned signal is a valid signal.

Despite efforts to prevent it, fraudulent prescreening of tickets is still a problem in the industry. The present invention relates to a novel approach of detecting whether attempts have been made to prescreen tickets by focusing on whether the scratch-off material covering the play indicia or security codes has been tampered with.

SUMMARY OF THE INVENTION

Objects and advantages of the invention will be set forth in the following description, or may be obvious from the description, or may be learned through practice of the invention. It is intended that the invention include modifications and variations to the systems and method embodiments described herein.

A scratch-off lottery ticket is provided as a substrate having at least one play area with play indicia provided thereon. The lottery ticket may relate to any game theme, such as bingo, poker, crossword puzzles, and so forth. A scratch-off layer is disposed over the play indicia and, after purchasing the ticket, a player removes the scratch-off layer to reveal the play indicia, which indicates whether the ticket is a winning ticket. To provide a means for detecting whether the lottery ticket has been compromised by unauthorized removal of a portion of the scratch-off material prior to sale of the ticket, a luminescent material is provided on the ticket. This luminescent material is disposed relative to the scratch-off layer and the play indicia such that any removal of the scratch-off layer to reveal the underlying play indicia is rendered optically apparent upon subsequent excitation of the luminescent material.

In a particular embodiment, the luminescent material may be one of a fluorescent or phosphorescent compound. The compound may in an additive to a layer underlying the scratch-off material. For example, the luminescent compound may be added to a generally clear protective coating that is applied over the play indicia. In an alternate embodiment, a fluorescent ink layer may be printed under the scratch-off layer. In still another embodiment, the luminescent compound may be added to the ink compound used to print the play indicia. It should be appreciated that the luminescent compound may be a component of any one or a multiple of layers that underlie the scratch-off layer. Upon irradiation of the play area with an excitation source, any of the luminescent material that is exposed through a breach in the scratch-off layer will emit a detectable luminescent optical signature as an indication that the ticket has been compromised.

In a particularly unique embodiment, the luminescent material is a component of the scratch-off layer. With this embodiment, removal of any portion of the scratch-off layer results in an optically apparent lack of luminescence upon excitation of the play area with an excitation source.

The present invention also encompasses a system for detecting whether scratch-off lottery tickets have been compromised by unauthorized removal of a portion the scratch-off layer prior to sale of the tickets. The system includes lottery tickets as described above having a luminescent material disposed relative to the scratch-off layer and the play indicia such that removal of the scratch-off layer to reveal the underlying play indicia is rendered optically apparent upon subsequent excitation of the luminescent material. The system includes an excitation source configured to emit an excitation energy that causes the luminescent material to produce an optically detectable signal, and a display configured with the excitation source to display results of the excitation of the lottery tickets. In a particular embodiment, the excitation source is a scanner through which the lottery tickets are conveyed, with the scanner individually irradiating the lottery tickets with the excitation energy. The scanner is in communication with any manner of local or remote display screens that depict the individual scans of the lottery tickets. If the luminescent material underlies the scratch-off layer, a compromised ticket is indicated by an optically detected luminescence pattern in the play area resulting from removal of the scratch-off material and exposure of the underlying luminescent material to the excitation energy. If the luminescent material is contained in the luminescent material, a compromised ticket is indicated by a lack of or break in the luminescence pattern over the play area resulting from removal of a portion of the scratch-off layer.

The present invention also encompasses a method for detecting compromised scratch-off lottery tickets of the type discussed above, and includes providing a luminescent material on the lottery ticket in the play area. At least the play area is scanned prior to sale of the ticket with an excitation source that emits an excitation energy that causes the luminescent material to produce an optically detectable luminescent signal. The scanned images of the lottery tickets are displayed in a format such that any unauthorized removal of the scratch-off layer to reveal the underlying play indicia is rendered optically apparent in the displayed scanned images.

Other objects and advantages of the method and system of the present invention may become apparent to those skilled in the art through practice of the invention.

DETAILED DESCRIPTION

Reference will now be made to one or more embodiments of the system and methodology of the invention as illustrated in the figures. It should be appreciated that each embodiment is presented by way of explanation of aspects of the invention, and is not meant as a limitation of the invention. For example, features illustrated or described as part of one embodiment may be used with another embodiment to yield still a further embodiment. It is intended that the invention include these and other modifications that come within the scope and spirit of the invention.

Figure 1:
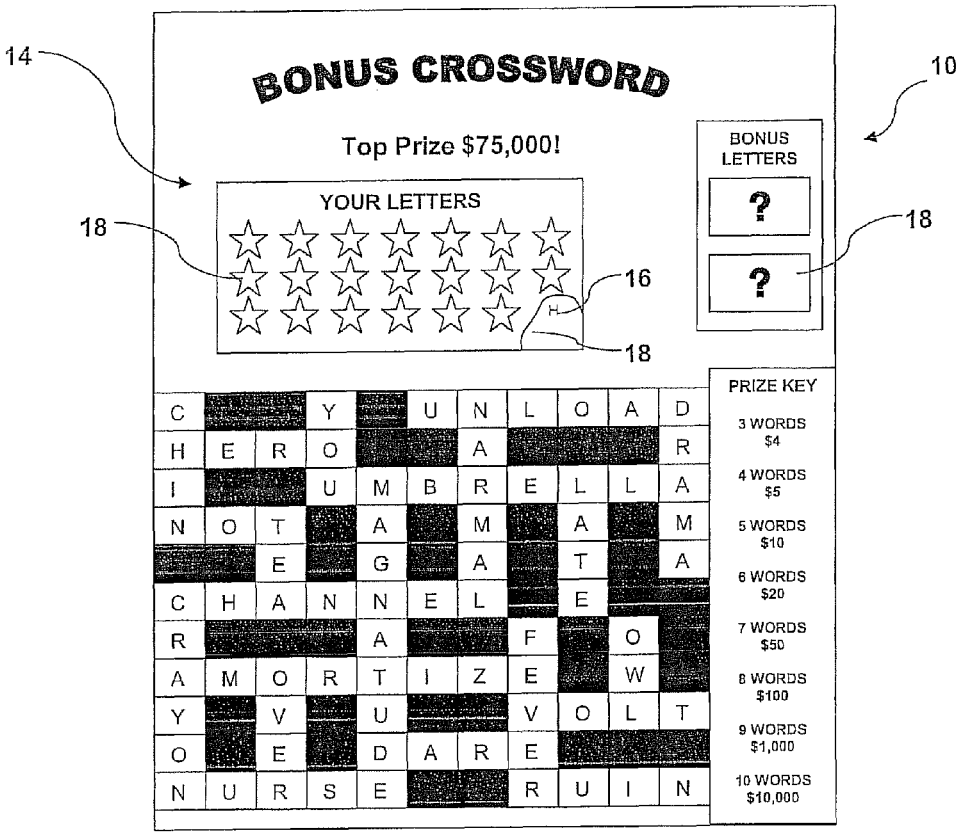
FIG. 1 is a front plan view of a representative scratch-off instant lottery ticket.
Figure 2A:
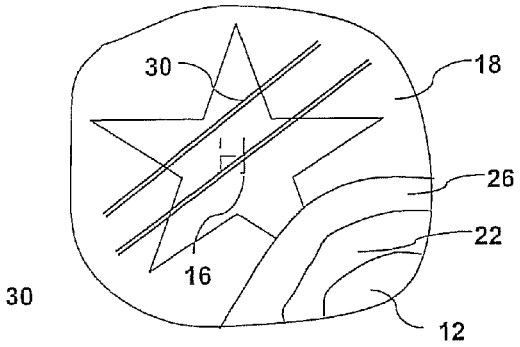
FIG. 2A is an enlarged frontal view of a portion of a scratch-off lottery ticket having the play indicia covered by a scratch-off coating.
Figure 2B:
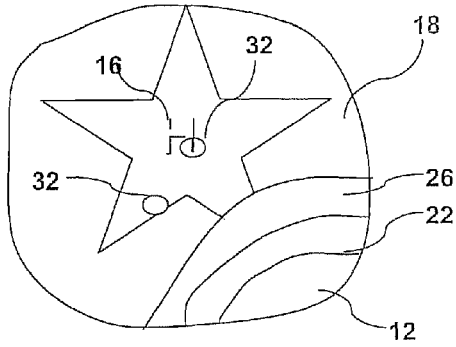
FIG. 2B is an enlarged frontal view of a portion of a scratch-off lottery ticket having the play indicia covered by a scratch-off coating.

Referring to FIGS. 1, 2A, and 2B in general, a scratch-off lottery ticket 10 is illustrated. Numerous examples of scratch-off lottery game tickets are known in the art, and the present invention is applicable to any such game tickets. It should be appreciated that the invention is not limited to any particular type of scratch-off lottery game. In general, the tickets 10 relate to a game theme, such as bingo, poker, a crossword game, and the like. The ticket includes a base substrate material 12, such a paper, foil, coated board, or other known materials. Depending on the type of material, the substrate 12 may be coated to produce a desirable printing surface. One or more ink layers 22 are typically printed onto the substrate 12 to produce the desired aesthetic appearance, game indicia, play indicia instructions, and the like.

A section of the card 10 is designated as the play area 14 and includes any manner of printed play indicia 16. The play indicia 16 relates to the lottery game and dictates whether the ticket 10 is a winning or loosing ticket. For example, in the illustrated embodiment, the play indicia 16 are letters that are used to form words in the crossword puzzle. The prize is a function of the number of words in the puzzle that can be formed with the set of play indicia letters 16.

As is well understood in the art, the play indicia 16 is covered by a removable scratch-off layer or coating 18 that is formulated to be easily removed by a player after purchasing the ticket 10 to reveal the underlying play indicia 16. The scratch-off layer 18 is typically latex which breaks into particles or collapses from the underlying layer when scratched. Suitable scratch-off materials are well known in the art, and any such material may be used to practice the invention.

It is common practice in the art to provide a generally clear protective layer 26 over the game indicia 16. This layer is typically a hard gloss layer that functions to prevent damage to the game indicia 16 when the overlying scratch-off layer is removed by the player with a fingernail or other implement.

Referring to FIGS. 2A and 2B, attempts may be made to prescreen the lottery tickets 10 by removing minute portions of the scratch-off layer 18 that overlies the game indicia 16. For example, in FIG. 2A, fine scratches 30 may be etched into the layer 18 in an attempt to discern the underlying play indicia 16. In FIG. 2B, small holes 32 or sections of the layer 18 may be removed for the same purpose. Various other attempts may be made to "breach" the scratch-off layer 18 to an extent such that the underlying indicia 16 is discernable.

To provide an optical indication that an attempt has been made to compromise the lottery ticket 10 by removing a portion of the scratch-off layer 18, a luminescent material 20 is incorporated into one or more of the layers on the substrate 12. This luminescent material 20 may be any substance generally capable of producing a luminescent signal that is detectable visually or by an instrumental device upon being exposed to an excitation energy. Any number of known luminescent compounds (e.g., fluorescent, phosphorescent, etc.) may be used for this purpose. For example, suitable fluorescent compounds may include, but are not limited to, fluorescein, europium chelates, phycobiliprotein, rhodamine, and their derivatives and analogs. Other suitable fluorescent compounds are semiconductor nanocrystals commonly referred to as "quantum dots." For example, such nanocrystals may contain a core of the formula CdX, wherein X is Se, Te, S, and so forth. The nanocrystals may also be passivated with an overlying shell of the formula YZ, wherein Y is Cd or Zn, and Z is S or Se. Other examples of suitable semiconductor nanocrystals may also be described in U.S. Pat. No. 6,261,779 to Barbera-Guillem, et al. and U.S. Pat. No. 6,585,939 to Dapprich.

Further, suitable phosphorescent compounds may include metal complexes of one or more metals, such as ruthenium, osmium, rhenium, iridium, rhodium, platinum, indium, palladium, molybdenum, technetium, copper, iron, chromium, tungsten, zinc, and so forth. Especially preferred are ruthenium, rhenium, osmium, platinum, and palladium. Bipyridine metal complexes may also be utilized as phosphorescent compounds. Still other suitable metal complexes that may exhibit phosphorescent properties are described in U.S. Pat. No. 6,613,583 to Richter, et al.; U.S. Pat. No. 6,468,741 to Massey, et al.; U.S. Pat. No. 6,444,423 to Meade, et al.; U.S. Pat. No. 6,362,011 to Massey, et al.; U.S. Pat. No. 5,731,147 to Bard, et al.; and U.S. Pat. No. 5,591,581 to Massey, et al.

Luminescent compounds, such as described above, may be used alone as an additive to one or more of the ink or protective layers provided on the lottery ticket substrate, or in conjunction with a particle (sometimes referred to as "beads" or "microbeads"). For example, in one embodiment, latex microparticles that are labeled with a fluorescent dye may be utilized. Suitable particles may be described in U.S. Pat. No. 5,670,381 to Jou, et al.; U.S. Pat. No. 5,252,459 to Tarcha, et al.; and U.S. Patent Publication No. 2003/0139886 to Bodzin, et al. Commercially available examples of suitable fluorescent particles include fluorescent carboxylated microspheres sold by Molecular Probes, Inc. under the trade names "FluoSphere" (Red 580/605) and "TransfluoSphere" (543/620), as well as "Texas Red" and 5- and 6-carboxytetramethylrhodamine, which are also sold by Molecular Probes, Inc.

The luminescent material may be any one or combination of commercially available fluorescent dyes in water-based liquid or dry form, or non water-based form. Such dyes are typically used as "invisible ink" compositions in many industries to discreetly mark property or documents to prove ownership or prevent fraud, mark patrons for readmission to an event, add security to document identification, and so forth. These inks are generally invisible until exposed to an excitation source, such as a an ultraviolet (UV) light source. The inks may be added as a component to an existing layer on the lottery ticket substrate, for example as an additive to the clear protective layer applied over the play indicia. In alternate embodiments, the fluorescent ink layer may be printed as an additional layer over the indicia ink layer in the play area.

Figure 3:
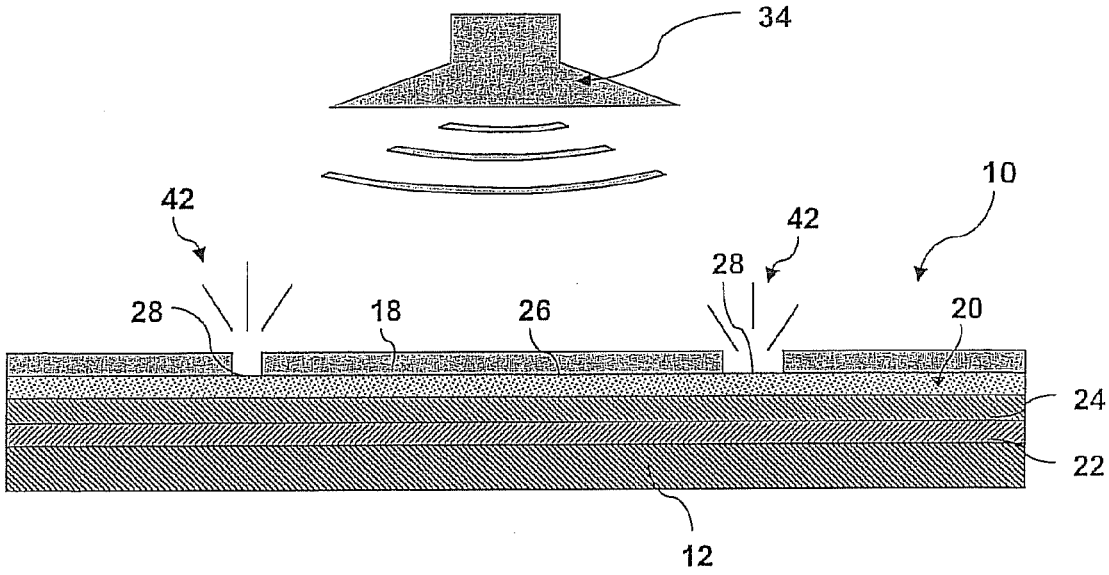
FIG. 3 is a diagrammatic cross-sectional view of an embodiment of an instant lottery ticket in accordance with aspects of the invention.

FIG. 3 depicts a unique embodiment wherein the base substrate 12 includes a first ink layer 22 and a second ink layer 24 that define game indicia and play indicia in the play area of a lottery ticket 10. A clear-coat protective layer 26 is applied over the ink layers to protect the indicia. A removable scratch-off layer 18 is applied over the protective layer 26. Two breaches 28 of the scratch-off layer are indicated in FIG. 3. As discussed, these breaches 28 represent the removal of a minute portion of the scratch-off layer 18 in an attempt to discern the underlying play indicia. In this particular embodiment, the protective layer 26 includes the luminescent material 20 as a component thereof. For example, the luminescent material 20 may be a fluorescent dye or microspheres that are mixed with the coating formulation.

FIG. 3 also represents the lottery ticket 10 being exposed to an excitation source 34. This source 34 emits a particular radiation that excites the luminescent material 20. Any material 20 that is exposed to the excitation source 34 through a breach 28 in the scratch-off layer 18 will react to the radiation and emit an optically detectable luminescent signature 42 that is visible to the naked eye or to detection circuitry in a scanner or reader. For example, the luminescent material 20 may be a fluorescent compound, and the excitation source 34 may be a UV light source that causes any of the exposed material to "glow." Upon exposing at least the play area 14 of the ticket 10 to the excitation source 34, an inspector would look for any visible signs of a fluorescent pattern 42 in the play area 14 as an indication that the lottery ticket 10 has been compromised.

Figure 4:
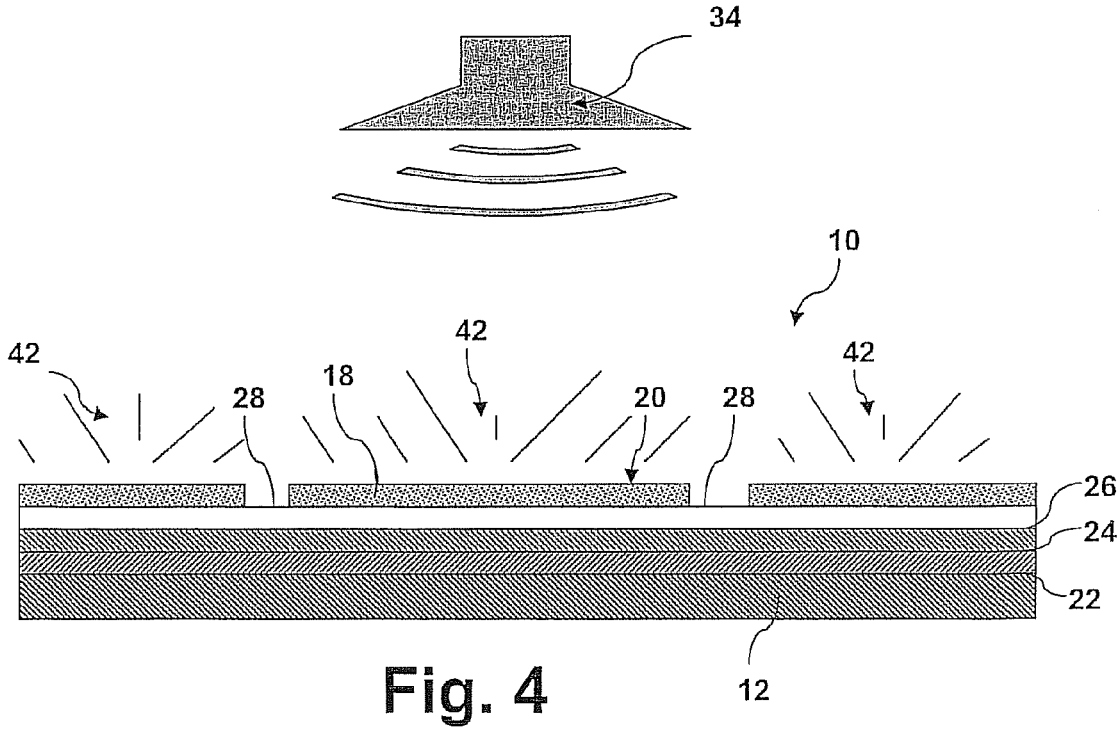
FIG. 4 is a diagrammatic cross-sectional view of an alternate embodiment of an instant lottery ticket in accordance with aspects of the invention.

FIG. 4 represents an embodiment wherein the scratch-off layer 18 includes the luminescent material 20 homogeneously mixed therewith. Thus, upon exposure of the ticket 10 to the excitation source 34 the entire surface of the scratch-off layer 18 will emit a luminescent pattern 42. Any breaches 28 of the layer 18 will be indicated by an absence of the luminescent pattern 42. In other words, an inspector would look for holes or dark spots in the luminescent pattern 42 as an indication that the ticket 10 has been compromised. In an alternative embodiment, the luminescent material 20 may be applied as a geometric pattern over the surface of the scratch-off layer 18, such as a pattern of fine stripes. Any breaches 28 in the layer 18 would produce a visually distinct interruption of the pattern.

Figure 5:
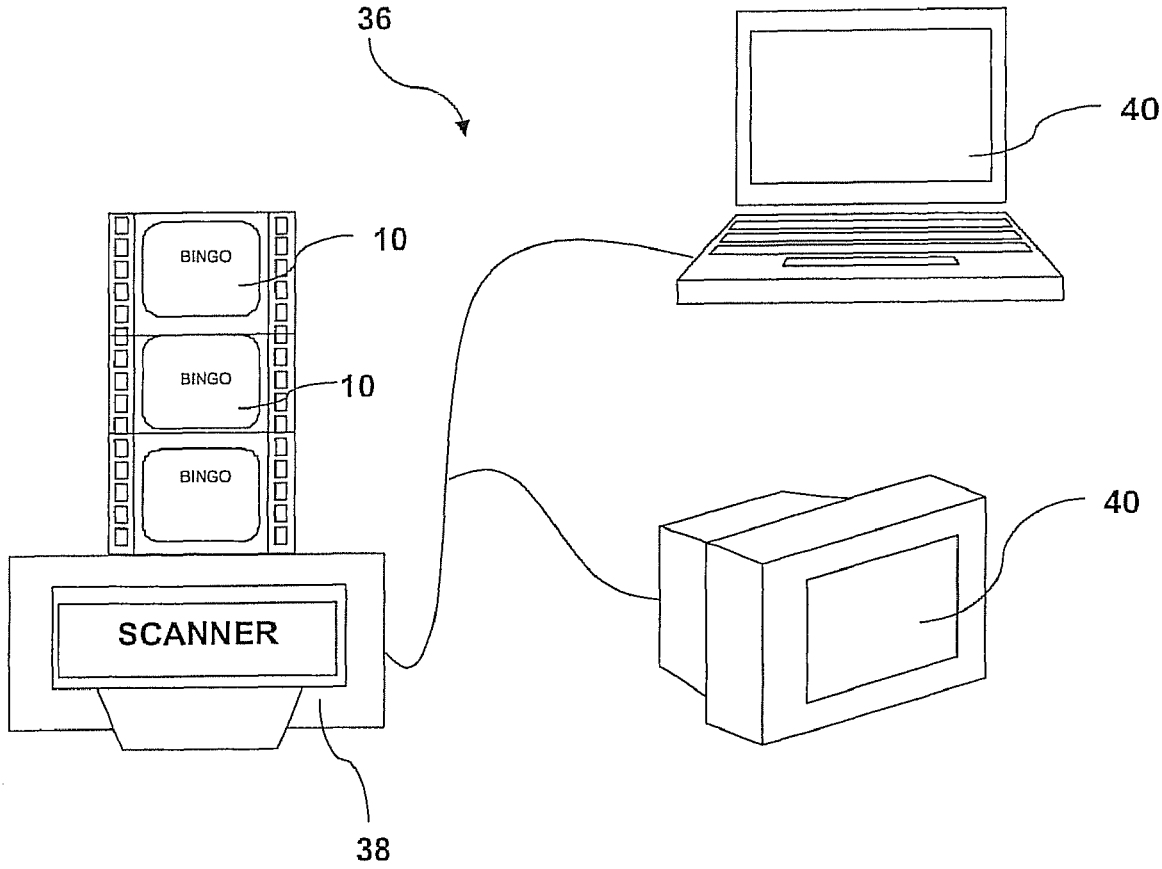
FIG. 5 is a diagrammatic view of an exemplary system for detecting compromised lottery tickets in accordance with aspects of the invention.

FIG. 5 illustrates the basic concepts of a system 36 for detecting whether scratch-off lottery tickets 10 have been compromised by unauthorized removal of a portion the scratch-off layer 18 prior to sale of the tickets, in accordance with the principles discussed above. The system 36 includes lottery tickets 10 as described above having a luminescent material disposed relative to the scratch-off layer and the play indicia such that removal of the scratch-off layer to reveal the underlying play indicia is rendered optically apparent upon subsequent excitation of the luminescent material. The system 36 includes an excitation source within a scanner 38 through which the lottery tickets 10 are conveyed, with the scanner individually irradiating the lottery tickets 10 with the excitation energy. The scanner 38 may include a dedicated viewing option, such as a display screen incorporated with the scanner 38, or the scanner 38 may be in communication with one or more remote display screens 40 that are monitored by lottery or law enforcement officials, or others.

The system 36, particularly the scanner 38, may be an in-line component at the point-of-sale of the lottery tickets so that purchasing players may view a scan of the ticket they are about to purchase. This configuration may increase the public's confidence in the system integrity and encourage ticket sales. In alternate embodiments, the system 36 may be a portable unit that is used to conduct spot inspections of lottery tickets at various retail establishments. The system 36 may be a tool used by law enforcement officials in the investigation of lottery fraud, and the like.

It should also be readily appreciated by those skilled in the art that modifications and variations may be made to the embodiments of the system and methodology described herein without departing from the scope and spirit of the invention.

What is claimed is:

1. A scratch-off lottery ticket, comprising:

a substrate having at least one play area with play indicia provided thereon;

a luminescent scratch-off material layer disposed over said play indicia; and wherein an attempt to discern the play indicia by removal of a portion of said scratch-off layer results in an optically apparent lack of luminescence upon excitation of said play area with an excitation source such that the optically apparent lack of luminescence is only detectable when the player area is excited.

2. The scratch-off lottery ticket as in claim 1, wherein said luminescent scratch-off layer comprises one of a fluorescent or phosphorescent compound.

3. The scratch-off lottery ticket as in claim 1, wherein said luminescent scratch-off material layer exhibits a uniform luminescent pattern over the entire surface thereof.

4. The scratch-off lottery ticket as in claim 1, wherein said luminescent scratch-off material layer exhibits a geometric luminescent pattern over the surface thereof such that a visually discernable break in said pattern results from removal of a portion of said scratch-off material layer.

5. A scratch-off lottery ticket system for detecting compromised lottery tickets, comprising:

scratch-off lottery tickets, each of said tickets further comprising a substrate with at least one play area with play indicia provided thereon;

a luminescent scratch-off material layer disposed over said play indicia;

an excitation source configured to emit an excitation energy that causes said luminescent material to produce an optically detectable signal;

a display configured with said excitation source to display results of the excitation of said lottery tickets; and wherein an attempt to discern the play indicia by removal of a portion of said scratch-off material layer results in an optically apparent lack of luminescence upon excitation of said play area with said excitation source such that the optically apparent lack of luminescence is only detectable when the player area is excited.

6. The system as in claim 5, wherein said excitation source comprises a scanner through which said lottery tickets are conveyed, said scanner individually irradiating said lottery tickets with said excitation energy, said display comprising a video screen that depicts the individual scans of said lottery tickets.

7. The system as in claim 5, wherein said luminescent scratch-off material layer comprises one of a fluorescent or phosphorescent compound.

8. The system as in claim 5, wherein said luminescent scratch-off material layer exhibits a uniform luminescent pattern over the entire surface thereof.

9. The system as in claim 5, wherein said luminescent scratch-off material layer exhibits a geometric luminescent pattern over the surface thereof such that a visually discernable break in said pattern results from removal of a portion of said scratch-off material layer.

* * * * *